United States Patent [19]

Peterson

[11] 4,150,091

[45] Apr. 17, 1979

[54] MANGANESE ORE LEACHING PROCESS

[75] Inventor: Henry J. Peterson, Wilmington, Del.

[73] Assignee: Sun Ocean Ventures, Inc., Radnor, Pa.

[21] Appl. No.: 854,854

[22] Filed: Nov. 25, 1977

Related U.S. Application Data

[63] Continuation-in-part of Ser. No. 853,147, Nov. 18, 1977, abandoned.

[51] Int. Cl.[2] ..... C01G 3/04; C01G 53/08; C01G 45/02

[52] U.S. Cl. ..... 423/35; 423/39; 423/50; 423/109; 423/150; 423/DIG. 4

[58] Field of Search ..... 423/38–40, 423/48–50, 109, 150, DIG. 4, 35

[56] References Cited

U.S. PATENT DOCUMENTS

| | | | |
|---|---|---|---|
| 1,041,407 | 10/1912 | De Alzugary | 423/38 |
| 3,832,165 | 8/1974 | Kane et al. | 423/DIG. 4 |
| 4,026,773 | 5/1977 | Van Peteghem | 423/38 |

FOREIGN PATENT DOCUMENTS

| | | | |
|---|---|---|---|
| 2240586 | 2/1974 | Fed. Rep. of Germany | 423/DIG. 4 |

OTHER PUBLICATIONS

Ulrich et al., "The Processing of Manganese Nodules by Acid Leaching", *Interocean*'73, vol. I, pp. 1–23.

*Primary Examiner*—Brian Hearn
*Attorney, Agent, or Firm*—J. Edward Hess; Donald R. Johnson; Stanford M. Back

[57] ABSTRACT

The process of leaching manganiferous ocean nodule ores with HCl whereby the manganese and other metals present, such as iron, zinc, cobalt, nickel, copper, and like are converted from oxides, silicates or other insoluble forms to water soluble chlorides, and are thereafter separated, purified, and the manganese recovered as $MnO_2$ by oxidation with chlorine to provide a material suitable for use in metallurgical applications, may be improved by controlling the chlorine pressure and the pH of the leaching reaction in order to first leach out the metals other than manganese; as chloride, and thereafter recovering the manganese in the form of its silicate, aluminate, oxide, or the like.

18 Claims, No Drawings

MANGANESE ORE LEACHING PROCESS

CROSS REFERENCE TO RELATED APPLICATIONS

This application is a continuation-in-part of Ser. No. 853,147, filed November 18, 1977, in the name of Henry J. Peterson and entitled "Improved Manganese Ore Leaching Process", now abandoned.

BACKGROUND OF THE INVENTION

This invention relates to a process for the recovery of manganese from silicateous ores containing the same. More particularly, this invention relates to an improved process for preparing manganese obtained from ocean nodules in a form suitable for steel manufacture without having to highly purify the same. Still more particularly, this invention relates to a method for recovering such metals as zinc, copper, cobalt, nickel and the like from manganese-containing ocean nodule ores containing the same by controlled acid leaching.

U.S. Pat. No. 4,026,773, issued May 31, 1977, teaches one method for separating, recovering and purifying a mixture of metals found in manganiferous ocean nodule ores, e.g. iron, nickel, copper, zinc and the like which are found together in insoluble oxide, or silicate form or the like together with substantial amounts of manganese oxide.

In general, the method taught involves leaching various metals from ocean nodule ores with concentrated HCl at a pH of about $-1$ to form their soluble chloride counterparts, including $MnCl_2$, together with released chlorine gas, and thereafter sequentially separating each of the zinc, copper, nickel chlorides etc. from the leach solution, until there remains the $MnCl_2$, which comprises the largest proportion of the overall metals in the original ore. The $MnCl_2$ is then reconverted to manganese oxide by chlorine oxidation or the like, for industrial use. Thus, in accordance with this method, the manganese, although it is the largest component, is carried through each of the sequential separation steps as $MnCl_2$ until all of the other metals are first removed. Necessarily, then, much larger manufacturing facilities, and greater amounts of reagents and energy are required by this method than would be the case if all the metals other than manganese were separated from the ore first without it being necessary to convert manganese oxide to $MnCl_2$, carry it through the process, and then convert it back again to manganese oxide by oxidation. Moreover, inasmuch as the manganese to be used in steel manufacturing need not be as highly refined as this process provides, this prior art process results in a material which is purer than what is necessary.

In "The Processing of Manganese Nodules by Acid Leaching", W. H. Ulrich et al, INTEROCEAN '73, Second International Conference with Exhibition for Marine Research and Ocean Utilization, Vol. 1, it is disclosed that by leaching nodule ores with HCl or $H_2SO_4$ at temperatures between 200° to 250° C. in the presence of steam, copper and nickel could be selectively extracted, and that manganese extraction could be decreased with increasing temperatures. The use of these high temperatures and steam necessarily make such a process very energy-costly.

SUMMARY OF THE INVENTION

In accordance with the present invention, there is now provided a process for the hydrochloric acid leaching of manganiferous ocean nodule ores, said ores containing iron oxide, manganese oxide, silicon dioxide, alumina and metals comprising insoluble oxides and salts of copper, cobalt, nickel, and zinc, the improvement comprising regulating the pH, and chlorine pressure, of said process at temperatures of no more than 175° C., and preferably no more than 100° C., in order that the metals other than manganese oxide, iron oxide, silicon dioxide, and alumina are substantially solubilized to form their corresponding chloride salts and the manganese, iron, silicon and aluminum are recovered in their insoluble form.

This improvement is readily accomplished by selectively leaching the ocean nodule ore with HCl at controlled pH of about $-0.5$ to 1.0, and preferably about 0, and under controlled pressure for the evolved chlorine, sufficient to achieve an equilibrium reaction represented by the following equation;

$$\text{Ore} + 4HCl \rightleftarrows MnCl_2 + Cl_2 + 2H_2O$$

wherein the evolved chlorine, which would normally be vented off, is kept in solution in a closed system by maintaining ambient pressure or augmented pressure from an external source, at controlled temperatures of no more than 175° C. By the term "augmented pressure" is meant pressure attained by either adding chlorine to the system, or by controlling the space above the reactor by controlling the volume of the reaction medium, or both. In any event, the chlorine pressure should desirably range from about 400 psia at a pH of $-0.5$ to 0.01 psia at a pH of 1.0. The temperature at which these pressures and pH's are established is desirably in the range of from 25° to 175° C., and most preferably at 75° to 90° C. At these pH's and pressures, the HCl will selectively leach from the nodule virtually all of the metals present other than manganese, silicon and aluminum and any iron present, which materials remain in their insoluble form.

Inasmuch as the composition of a typical nodule comprises, in addition to the above-enumerated metals, such other principal metals as copper, zinc, cobalt and nickel, these metals are selectively solubilized as their respective chlorides, and thereafter routinely separated and recovered from solution. There may also be recovered small amounts of $MnCl_2$ derived from any lower valence, water-soluble manganese which was present in the nodule, which is more readily soluble in HCl then $MnO_2$, which latter material constitutes the major proportion of any manganese present. One typical method for separating and recovering these latter metals in purified form is disclosed, for example, in aforementioned U.S. Pat. No. 4,026,773.

The insoluble manganese, iron, silicon, and aluminum, generally in the form of $MnO_2$, $Fe_2O_3$, $SiO_2$ and $Al_2O_3$, are then in suitable condition as a composite mass for direct use in metallurgical applications, particularly in the manufacture of steel. That is to say, it is not necessary, for making manganese-containing steel, that the manganese be in pure form: the manganese mixture obtained by this process is useful substantially "as is", subject to adjustment of Mn-Fe ratios and the like.

It will thus be evident from the foregoing description that the process of the present invention provides a substantial advantage over that described in, e.g. U.S. Pat. No. 4,026,773, in that the need to reduce $MnO_2$ to $MnCl_2$ in order to solubilize this metal, followed by re-oxidation of the $MnCl_2$ with chlorine in the presence of $Mg(OH)_2$ or the like, to obtain manganese in a form that is purer than that necessary in steel manufacture, is thereby substantially eliminated. The resulting economies effected by reduced plant size, reagent costs, recycling and energy needs will be evident to those skilled in the art.

It will be evident from the foregoing description that this process provides sufficiently close control over the solubilization of the various metals by controlling the pH, chlorine pressure and temperature, that if desired, by decreasing the chlorine pressure, measured amounts of manganese can also be solubilized to form $MnCl_2$, thereby providing a residual ore of given manganese quantities, i.e. control of the head values of the ore.

The process of this invention will now be illustrated by, but not necessarily limited to, the following example.

EXAMPLE I

To a 1 liter titanium autoclave fitted with a gas inlet valve, magnetic stirring device, and a thermocouple is added 100 g. of deep ocean nodules, which has been dried overnight at 150° C. and sieved to 200 mesh. To this is added a solution of 0.9 moles of HCl dissolved in 500 cc $H_2O$, and the autoclave is quickly closed. The stirrer is turned on and the ambient pressure increased up to 25–30 psig. Additional chlorine pressure is added until the total pressure is about 50 psig. At this point the heat is turned on and the temperature of the reaction is raised to 90° C. It is kept at this temperature until a total pressure of about 70 psig is reached. The stirring is continued for two hours after this point. The reactor is allowed to cool back to room temperature, with stirring, and then the bottom drain is opened to allow the contents to exit into a 3 liter breaker containing 500 cc of water. The slurry is now quickly vacuum filtered to separate the pregnant liquor from the solids. The solids are now slurried twice with 500 cc portions of water and the wash water is added to the pregnant solution.

The original analysis of the nodules is shown in column 1 of Table 1 below; the analysis of the resulting aqueous solution is shown in column 2; the remaining solids have a calculated analysis, by difference on a dry basis, as shown in column 3.

TABLE I

| Element | Nodule Analysis (starting wt. %) | Solution Analysis (gm/l) | Solids Analysis (remainder-wt. %) |
|---|---|---|---|
| Mn | 29.0 | 1.45 | 26.1 |
| Cu | 1.09 | 0.5 | 0.09 |
| Ni | 1.29 | 0.6 | 0.09 |
| Zn | 0.15 | 0.06 | 0.02 |
| Co | 0.25 | 0.1 | 0.05 |
| Fe | 6.3 | 1.3 | 3.8 |

TABLE I-continued

| Element | Nodule Analysis (starting wt. %) | Solution Analysis (gm/l) | Solids Analysis (remainder-wt. %) |
|---|---|---|---|
| Al | 2.82 | 0.6 | 1.7 |
| $SiO_2$ | 13.93 | N.A. | N.A. |

NA = Not analyzed
*Compare starting wt. %

The invention claimed is:

1. In a process for the hydrochloric acid leaching of manganiferous ores, in a closed system, whereby chlorine is evolved, said ores containing iron oxide, manganese oxide, silicon dioxide, alumina and metals comprising insoluble oxides and salts of copper, cobalt, nickel, and zinc, the improvement comprising regulating the pH and chlorine pressure of said process at elevated temperatures under sufficient pressure to prevent the evolved chlorine from venting off from said closed system in order that metals other than manganese oxide are substantially solubilized to form the corresponding chloride salt, and manganese is separated in its insoluble form from said solubilized metals.

2. The process of claim 1 wherein the pH is from about −0.5 to 1.0.

3. The process of claim 1 wherein the pH is about 0.

4. The process of claim 1 wherein the temperature is not more than 100° C.

5. The process of claim 1 wherein the temperature is from about 25° C. to 100° C.

6. The process of claim 1 wherein the temperature is from about 75° C. to 90° C.

7. The process of claim 1 wherein the pressure ranges from about 0.1 psia to 400 psia.

8. The process of claim 1 wherein the chlorine pressure is the ambient pressure of evolved chlorine.

9. The process of claim 1 wherein the chlorine pressure is augmented by externally supplied chlorine.

10. The process of claim 1 wherein temperature is not more than 175° C.

11. The process of claim 10 wherein the pH is from about −0.5 to 1.0.

12. The process of claim 10 wherein the pH is about 0.

13. The process of claim 10 wherein the temperature is from about 25° C. to 100° C.

14. The process of claim 10 wherein the temperature is from about 75° C. to 90° C.

15. The process of claim 10 wherein the pressure ranges from about 0.1 psia to 400 psia.

16. The process of claim 10 wherein the chlorine pressure is the ambient pressure of evolved chlorine.

17. The process of claim 10 wherein the chlorine pressure is augmented by externally supplied chlorine.

18. The process of claim 10 wherein the temperature is in the range of from 100° to 175° C.

* * * * *